United States Patent [19]

Marshall et al.

[11] 3,999,263

[45] Dec. 28, 1976

[54] METHOD OF FORMING A MICRO-ARRAY MULTIBEAM GRID ASSEMBLY FOR A CATHODE RAY TUBE

[75] Inventors: Frederick John Marshall, Redwood City; Robert Leander Holm, Sunnyvale, both of Calif.

[73] Assignee: Litton Systems, Inc., San Carlos, Calif.

[22] Filed: Nov. 14, 1974

[21] Appl. No.: 523,668

[52] U.S. Cl. ..... 29/25.14; 29/25.18

[51] Int. Cl.[2] ..... H01J 9/02

[58] Field of Search ..... 29/25.1, 25.11, 25.13, 29/25.14, 25.15, 25.16, 25.17, 25.18, 592, 470.1, 472.9; 219/69 M; 313/348, 299, 293, 296, 300, 304

[56] References Cited

UNITED STATES PATENTS

| | | | |
|---|---|---|---|
| 2,980,984 | 4/1961 | Shrader et al. | 29/25.14 |
| 3,042,550 | 7/1962 | Allen et al. | 29/472.9 |
| 3,251,641 | 5/1966 | Gaylord | 29/25.14 |
| 3,297,902 | 1/1967 | Beggs | 29/25.14 |
| 3,297,906 | 1/1967 | Schumacher | 29/25.13 |
| 3,525,897 | 8/1970 | Du Pre | 29/25.15 X |
| 3,676,569 | 7/1972 | Thompson | 174/52 S |
| 3,686,727 | 8/1972 | Say et al. | 316/24 |
| 3,795,041 | 3/1974 | Hennicke | 29/472.9 |

OTHER PUBLICATIONS

J. J. Cuomo, "A Molybdenum To Copper Bond Utilizing Thermal Compression Gold Bonding," IBM Technical Disclosure Bulletin, vol. 7, No. 3, 8–1964, pp. 178, 179.

*Primary Examiner*—Richard B. Lazarus
*Attorney, Agent, or Firm*—Ronald M. Goldman

[57] ABSTRACT

The disclosed method of forming a control grid assembly having separate co-planar spaced grids for the electron gun of a multibeam cathode ray tube, includes the steps of forming a pair of identical metal wafers having two spaced holes, forming two waferlike insulating members having elongated slots, and forming a flat metal member having a rectangular framelike portion and a plurality of elongated spaced metal fingers extending to opposed frame portions inwardly toward one another within the frame portion and with opposed fingers separated by a distance less than the width of said slots. A sandwich of elements is formed with the third metal member in the center, an insulator member on each side thereof, and a metal member overlying said insulator members, and this assembly is aligned so that the holes of said members and said slots are in line, including aligning with a pin extended through opposed overlying holes and said intermdiately located slots, and with the end portion of each of said projecting metal fingers extending into the windows formed by each of the slots. The assembly is diffusion bonded to form a unitary assembly and a coolant fluid is introduced into the slots via said holes for cooling the sandwich and electrical discharge machining a plurality of minute holes through the sandwich at locations in line with corresponding ones of said projecting fingers so as to form a plurality of minute passages through each of the members and the projecting finger, and wherein eroded material may be flushed out from the slots by said fluid through said relatively large holes, and cutting away a portion of the framelike portion of the metal member to leave portions of spaced metal fingers extending outwardly from the sandwich of elements.

1 Claim, 4 Drawing Figures

METHOD OF FORMING A MICRO-ARRAY MULTIBEAM GRID ASSEMBLY FOR A CATHODE RAY TUBE

BACKGROUND OF THE INVENTION

1. Field of the Invention

This invention relates to a control grid subassembly as well as to a method of forming a grid assembly for an electron gun having particular utility in a multibeam cathode ray tube.

2. Description of the Prior Art

Multibeam cathode ray tubes are available which employ a plurality of individually controlled electron beams that are directed to the tube's phosphor screen to provide the predetermined display. Typically the electron gun in such a tube includes a cathode which emits electrons and a grid assembly which divides the electrons into many separately controlled electron beams or streams of electrons and includes a plurality of separate control grid elements each containing a passage theretrhough for permitting passage of an electron beam when the control grid is at a certain electrical potential or voltage applied through external circuits but which prevents the passage of the electron beam if a predetermined different electrical potential is applied to that grid.

Such grid assemblies have been fabricated by aligning together previously formed pierced or drilled parts using dowel pins and then clamping the parts together with nuts and bolts or by glass beading or by cementing using silica-alumina dental cements. The minute electron beam passages in each grid have typically been formed by drilling individual holes mechanically and by photoetching techniques. As a result, grid assemblies made by those methods require very precise parts. The assembly of those grid assemblies depends upon the maintenance of close tolerances in fit and in alignment between the component parts or elements of the grid assembly and the alignment dowel pins. As a result, grid assemblies for multibeam cathode ray tubes obtained by such methods have a degree of variation in performance in respect to array geometry modulation characteristics and beam diameter from one grid assembly to another.

SUMMARY OF THE INVENTION

Accordingly it is an object of the invention to provide a fabrication process for making a grid assembly which eliminates the need for accurate alignment of preformed parts.

It is a further object of the invention to provide a unique process by which the openings through the grid assembly are formed after the elements have been assembled together so as to avoid the problems of misalignment and obtain a desired degree of uniformity in structure from one grid assembly to another grid assembly.

And it is a still further object of the invention to provide a novel grid assembly for a cathode ray tube. framelike In accordance with the foregoing objects, the process of my invention includes the fabrication of at least two metal elements or grids of a thin flat waferlike shape having substantially identical pair of holes; the formation of at least two relatively thin flat waferlike elements of electrically insulated material containing substantially identical elongated slots; and a third metal member having a frame like portion of a length greater than the length of the foregoing elements and having within the framelike portion a plurality of opposed inwardly projecting fingers extending from oppositely facing surfaces of the said framelike portion aligning said elements into a sandwich with said third metal member in the center, an insulator member on each side thereof, and a metal grid member on each side of the insulator members with the elements aligned so that the holes in the metal members are in line with each other and with the opposite ends of the slots in the insulator members, including inserting an alignment pin through opposed holes and intermediately located slots; and wherein the ends of said projecting metal fingers extend into the window formed by said slots; bonding said members together; introducing coolant fluid into the slots via the holes and electrical discharge machining a series of minute holes through each of said metal members and metal fingers, whereby eroded material is flushed out the relatively larger holes, and cutting away a substantial portion of said framelike member of said third metal member to leave a plurality of extending metal fingers.

The foregoing and other objects and advantages of our invention together with the structure and steps characteristic of the invention are better understood from a consideration of the detailed description thereof which follows taken together with the figures of the drawings.

DESCRIPTION OF THE PREFERRED EMBODIMENTS

Figure 1:
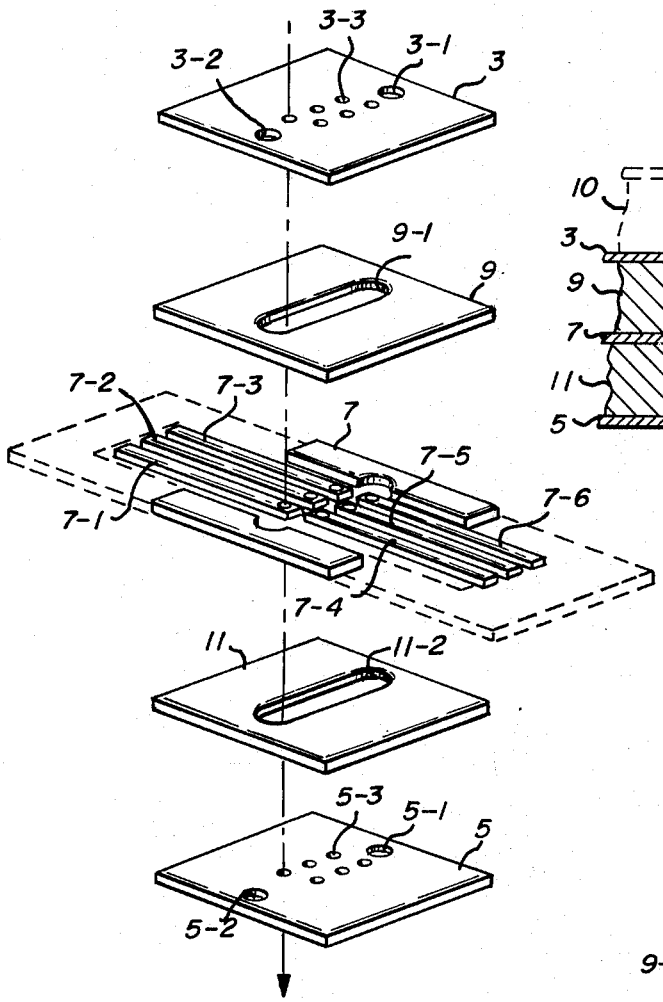
FIG. 1 illustrates in exploded view a grid assembly of the invention.

A control grid assembly constructed according to the invention is illustrated in the exploded view of FIG. 1. The figure shows the essential constituent element in somewhat enlarged scale. The grid assembly contains multiple control grids which includes a first grid member 3, a second grid member 5, and a third grid member 7. A first spacer member 9 is located between grid 3 and grid 7. A second spacer 11 is located between grid member 5 and grid member 7.

Each of grid members or grids 3 and 5 are, as illustrated, of a relatively thin waferlike shape and are constructed of an electrically conductive metal, suitably a conventional iron-nickel-cobalt alloy, such as "KOVAR". In one specific example, the waferlike grid members are substantially square in shape and may be on the order of ½ inch × ½ inch × 0.005 inch, length, width, and thickness, respectively. Each of grid members 3 and 5 includes two spaced holes, 3-1 and 3-2 in grid 3, and 5-1 and 5-2 in grid 5. These holes are spaced apart and geometrically located in the same position on member 3 as the corresponding holes are located on member 5 and these are used to align the grids during assembly hereinafter described. The alignment holes may be formed in the grids by mechanical drilling with one overlying the other. A series of additional holes, substantially smaller in diameter than holes 3-1 and 3-2 are also formed in grid members 3 and 5. For convenience only one of the small holes in each, 3—3 and 5–3, is labeled.

Spacers 9 and 11 are of electrically insulative material such as aluminum oxide and, as is illustrated, the spacers are of a relatively flat square waferlike geometry and in the specific example described is ½ inch × ½ inch × 0.005 inch length, width and thickness.

Spacer 9 includes an elongate slot 9-1 of a predetermined length and width and spacer member 11 includes an elongate slot 9-2, substantially identical in size, shape and location to slot 9-1. As is apparent from the figure, the distance between the ends of each of the slots 9-1 and 9-2 is the same as the distance between the end of hole 3-1 and the end of hole 3-2 in grid member 3 and the end of hole 5-1 and 5-2 in grid member 5, for initial alignment purposes hereinafter more fully explained.

Grid member 7, centrally located in the figure, includes a plurality of separate parts formed from a larger metal member. The larger metal member, partly indicated in dashed lines in the figure, for reasons that become more apparent from the description of the fabrication process includes a flat picture-framelike periphery and a plurality of spaced projecting flat elongate rectangular shaped metal fingers, 7-1, 7-2, 7-3, 7-4, 7-5 and 7-6. The framelike portion of grid 7 is at a length greater than the length of the other grids and may have the same width as those grids so as to permit a portion of each finger to extend beyond the end of the spacers and the other grids. Fingers 7-1, 7-2 and 7-3 extend from the inner edge of the narrow frame portion inwardly and fingers 7-4, 7-5 and 7-6 extend from the inner edge of the frame portion opposite to that supporting the first described fingers. The fingers on one frame portion extend toward but do not contact the fingers on the other frame portion and are axially displaced or staggered. Suitably, the distance axially between the edge end of finger 7-1 and the corresponding edge end of finger 7-4 is less than the height of the slots 9-1 and 11-2. The length of the fingers as well as the framelike portion is greater than the corresponding width of each of the waferlike members 3, 9, 11 and 5.

Grid member 7 is formed of metal, suitably an iron-nickel-cobalt alloy, by any conventional photoetching technique.

Preferably the outer surface of each of the metal members 3, 5 and 7 are coated with a flash of gold or other metals having similar diffusion bonding properties, and the opposed flat surfaces which face a grid of each of the spacers 9 and 11 are coated or plated with a flash of chromium and then a flash of gold.

The five elements illustrated, basic to the grid assembly of the invention, are aligned by inserting a straight cylindrical alignment pin through openings 3-1, slot 9-1 through the metal member 7, slot 11-2 and hole 5-1, and a second alignment pin through holes 3-2 and 5-2 and the intermediate slots.

The metal selected for the grids and the insulator selected for the spacers have substantially the same coefficient of thermal expansion so that when bonded together into a sandwich, the elements do not separate or break apart during normal variations in temperature which ensues during processing of a cathode ray tube of which the sandwich subsequently forms a part.

Figure 2:
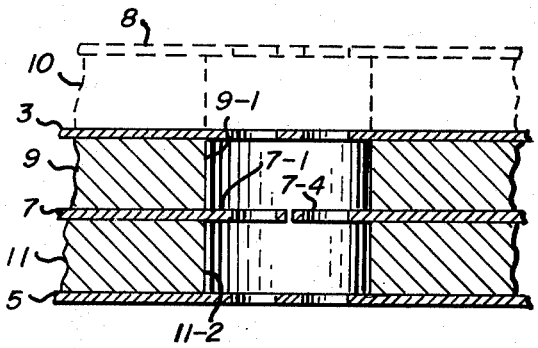
FIG. 2 illustrates in section a side view of a grid assembly of the invention.

The partial cross-section view of a grid assembly is presented in FIG. 2. For convenience, where the elements presented in FIG. 2 are the same as those described in FIG. 1, the elements are identified by the same numbers used to identify them in FIG. 1. As presented in partial section, there is the first grid 3, the first spacer member 9, the second grid 7, the second spacer member 11 and the third grid 5. Two of the smaller openings in the grids, which serve as passages for electron beams, are illustrated in each of grids 3 and 5. The opening in metal finger 7-1 and metal finger 7-4 appear in this view. The ends of the finger are spaced by a very slight distance. As is apparent, the height of the passage formed by the slots 9-1 and 11-2 is greater than that formed by the distance between electron beam openings in metal members 3 and 5, and the slots 9-1 and 11-2 form essentially windows into which the ends of the metal fingers extend.

Figure 3:
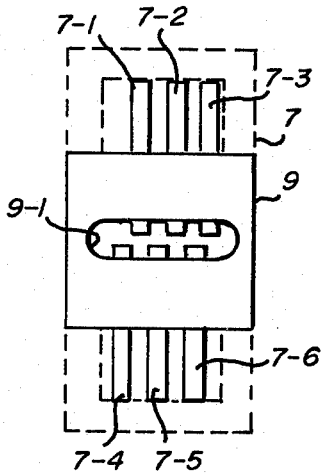
FIG. 3 illustrates the geometrical relationship between certain elements of the grid assembly.

This geometrical relationship between the slots and the metal fingers of the control grids is more clearly seen in the top view of FIG. 3 in which the spacer 9 overlies the metal member 7 containing the individual control grids 7-1 through 7-6. The top control grid 3 is omitted in this figure.

Returning to the section view of FIG. 2, an additional control grid 8 and an additional spacer 10 are illustrated in dash lines. The construction of and shape of grid 8 and spacer 10 is the same as that of the grid 3 and spacer 9 previously described. Thus additional control grids can be added or stacked into the basic elements of the grid assembly of the invention as desired.

Figure 4:
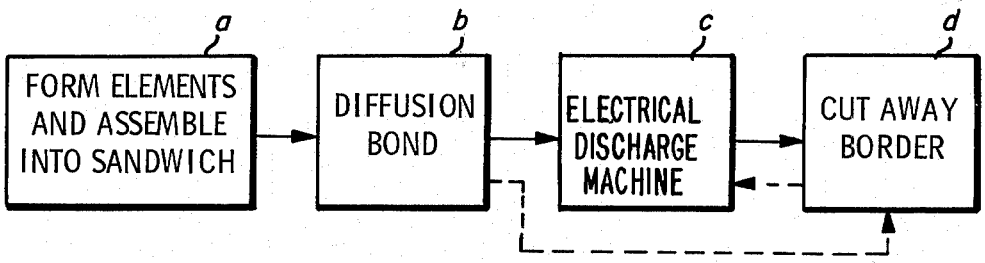
FIG. 4 illustrates in block diagram form the steps of the process invention.

Reference is now made to FIG. 4 with which to complete the description of the novel fabrication process of the invention. As a first step, each of the aforedescribed grids and spacers is formed with the alignment openings, slots, etc. as expressly delineated in connection with the description of FIGS. 1, 2, and 3. And the elements are assembled and aligned to form a sandwich in the configuration illustrated in FIG. 1 and in FIG. 2 as represented by *a* in FIG. 4. The elements are next joined together to permanently form the elements into a single unit by diffusion bonding, a known process obtained by pressing the elements together in a high temperature atmosphere as represented at *b* in FIG. 4. Next, each of the individual electron beam passages are formed in the sandwich by conventional electrical discharge machining process, as represented by *c* in FIG. 4. This is a process in which metals may be worked to desired shapes or holes pierced, unwanted metal is removed by means of an electric discharge or "arc", as is well known to those skilled in the art.

In connection with this, reference is again made to FIG. 1. The first hole 3—3 is formed by electrical discharge machining. This hole is located overlying the finger 7-3 and by continued electrical discharge machining the electron beam passage is drilled through this finger. Continuing, the electron beam extends through slot 11-2 and forms the electron beam hole 5-3 in grid member 5. This process is repeated until the number of electron beam holes is formed in line through the tip of the corresponding finger.

During the electrical discharge machining process it is sometimes convenient to use an oil or other coolant fluid which may enter through holes 3-1 and 3-2 and the area of the slot 9-1 and at the same time flush out any impurity or waste material created in the electrical discharge machining process.

The assembly is then cleaned in any convenient manner, such as by ultrasonic agitation in an organic solvent, as is well known to those skilled in the art.

As a final step a substantial portion of the metal member 7 is cut away to form the grid 7 as represented by *d* in FIG. 4. The cut-away portion is illustrated in FIG. 1 by the dash lines. After cutting, the plurality of projecting metal fingers or tabs through which the electrical control potentials may be applied to individual ones of the plurality of controlled grids remain. Obviously the metal member 7 may be cut prior to electrical discharge machining of the minute openings as desired, so that steps *c* and *d* in FIG. 4 are interchanged as represented by the dash lines in FIG. 4. As a practical matter, it has been found more convenient to cut after piercing the holes since it is necessary to have electrical connection to the metal member 7 during the electrical discharge machining process. As is apparent, additional control grids may be formed in such an assembly by adding another insulator and another metal member, such as 11 and 5, respectively, with the additional parts formed in the same manner as previously described.

As is apparent from the foregoing description, the electron beam openings are accurately aligned since they are formed after all of the parts are assembled and have been joined permanently together. There thus results a greater uniformity between grid assemblies constructed in the foregoing manner as compared to earlier fabrication processes where the minute passages are formed prior to assembly and thereafter aligned and joined together. Further the use of the electrical discharge machining for drilling holes avoids mechanical drilling which might otherwise cause a mechanical deformation of the structure. With the elements permanently bonded together, the assembly is inherently more stable than one in which the elements are clamped together.

It is believed that the foregoing description of the preferred embodiment of the invention is sufficient to enable one skilled in the art to readily make and use the grid assembly of the invention and the novel fabrication process. However it is expressly understood that my invention is not to be limited to the details disclosed in connection with the description of the preferred embodiment of the invention inasmuch as other substitutes and equivalents thereto as well as modifications and improvements which come within the invention become apparent to one skilled in the art upon reading this specification.

Accordingly it is requested that the invention be broadly construed within the full spirit and scope of the appended claims.

What is claimed is:

1. The method of forming a control grid assembly having separate co-planar spaced grids for the electron gun of a multibeam cathode ray tube, comprising the steps of:

forming a pair of substantially identical waferlike metal members of a predetermined width and length, said members having at least two spaced holes therethrough;

forming a pair of substantially identical waferlike insulating members of said predetermined length and width, said members having elongated slots therethrough to form windows;

forming a third relatively flat metal member having a rectangular framelike portion and a plurality of elongated spaced metal finger members extending from two opposed frame portions inwardly toward one another within said framelike portion with opposed fingers separated by a distance less than the width of said slots in said insulator members; and said framelike portion having a width greater than the width of said insulator members and of said pair of metal members;

forming a sandwich of said elements with said third metal member in the center, an insulator member on each side thereof and one of said metal members overlying said insulator members on each side thereof and aligning same so that said holes of said members and said slots are in line, including aligning with a pin extended through opposed overlying holes and said intermediately located slots, and with the end portion of each of said projecting metal fingers extending into the windows formed by each of said slots in said insulator members;

diffusion bonding said members together to form a unitary assembly;

introducing a coolant fluid into said slots via said holes for cooling said sandwich and electrical discharge machining a plurality of minute holes through said sandwich of elements at locations in line with corresponding ones of said projecting fingers whereby a plurality of minute passages are formed along an axis through said first metal member, through a projecting metal finger and said second metal member and whereby eroded material may be flushed out from the slots by said fluid through said relatively large holes; and cutting away a sufficient portion of said framelike portion of said third metal member to leave portions of said spaced metal fingers extending outwardly from said sandwich of elements.

* * * * *